US008066587B2

(12) United States Patent
Tateno et al.

(10) Patent No.: US 8,066,587 B2
(45) **Date of Patent: *Nov. 29, 2011**

(54) PUTTER HEAD

(75) Inventors: Atsuo Tateno, Tokyo (JP); Tatsuya Ishikawa, Tokyo (JP); Wataru Ban, Saitama (JP); Fumiaki Sato, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 110 days.

This patent is subject to a terminal disclaimer.

(21) Appl. No.: 11/930,798

(22) Filed: Oct. 31, 2007

(65) Prior Publication Data

US 2008/0125240 A1 May 29, 2008

(30) Foreign Application Priority Data

Nov. 27, 2006 (JP) ..... P2006-318691
Dec. 27, 2006 (JP) ..... P2006-351577

(51) Int. Cl.
*A63B 53/04* (2006.01)

(52) U.S. Cl. ..... 473/331; 473/340; 473/342

(58) Field of Classification Search ..... 473/324–350
See application file for complete search history.

(56) References Cited

U.S. PATENT DOCUMENTS

| | | | | | |
|---|---|---|---|---|---|
| 4,530,505 | A * | 7/1985 | Stuff | 473/250 |
| 4,792,139 | A * | 12/1988 | Nagasaki et al. | 473/342 |
| 4,884,812 | A * | 12/1989 | Nagasaki et al. | 473/342 |
| 5,405,137 | A * | 4/1995 | Vincent et al. | 473/342 |
| 5,472,201 | A * | 12/1995 | Aizawa et al. | 473/329 |
| 5,766,087 | A * | 6/1998 | Kawamatsu | 473/290 |
| 6,287,215 | B1 * | 9/2001 | Fisher | 473/309 |
| 6,743,117 | B2 * | 6/2004 | Gilbert | 473/332 |
| 7,285,057 | B2 * | 10/2007 | Mann et al. | 473/331 |
| 7,448,961 | B2 * | 11/2008 | Lin | 473/332 |
| 2006/0154739 | A1 | 7/2006 | Mann, Jr. et al. | |
| 2008/0125241 | A1 * | 5/2008 | Tateno et al. | 473/331 |

FOREIGN PATENT DOCUMENTS

| | | | |
|---|---|---|---|
| GB | 2 401 798 | A | 11/2004 |
| GB | 2 440 799 | A | 2/2008 |
| JP | 6-19760 | U | 3/1994 |
| JP | 10179815 | A * | 7/1998 |
| JP | 11-137746 | A | 5/1999 |
| JP | 2000014836 | A * | 1/2000 |
| JP | 2000093565 | A * | 4/2000 |
| JP | 2000-254256 | A | 9/2000 |
| JP | 2001161868 | A * | 6/2001 |
| JP | 2003-000777 | A | 1/2003 |
| JP | 2004-236985 | A | 8/2004 |
| JP | 2005052400 | A * | 3/2005 |
| JP | 2005-296204 | A | 10/2005 |

OTHER PUBLICATIONS

Japanese Office Action issued Sep. 13, 2011 in corresponding Japanese Patent Application No. 2006-351577.

* cited by examiner

*Primary Examiner* — Alvin Hunter
(74) *Attorney, Agent, or Firm* — Sughrue Mion, PLLC

(57) ABSTRACT

A putter head includes substantially parallel plural grooves formed on a face thereof, wherein a ratio W/S of a groove width W (mm) and a space width S (mm) between the grooves is from 0.5 to 2.0.

9 Claims, 6 Drawing Sheets

PUTTER HEAD

BACKGROUND OF THE INVENTION

1. Field of the Invention

The present invention relates to a putter head for golfing, and more particularly to a putter head having grooves on a face thereof.

2. Description of the Related Art

A putter head is a head part of a putter, which is a golf club for rolling a ball on a green. According to JP-A-2003-777, often found is a face having grooves, formed by a cutting work with a milling machine and called a milled pattern, over the entire surface of the face in an equidistant arc-shaped pattern when seen from a front side of the face. Such grooves are provided for various advantages such as for obtaining a soft feeling owing to a reduced contact area with the golf ball, avoiding a ball slippage in a state where the face is wetted with rain or dew, and providing a good appearance by a designed pattern, and are often found in putter club head for an advanced player, giving emphasis on feeling of hitting and of use.

JP-A-2003-777 defines a space between grooves as from 0.3 to 3 mm, a groove depth as from 0.03 to 0.3 mm, and a radius of the arc-shaped groove as from 8 to 80 mm.

SUMMARY OF THE INVENTION

A putter head generally has a loft angle of from 2 to 5°, and a photographing with a high-speed camera reveals that the gold ball is given a backspin immediately after the impact. Such backspin hinders the rolling of the golf ball. An object of the present invention is to provide a putter head so improved as to reduce the backspin.

According to a first aspect of the invention, there is provided a putter head including substantially parallel plural grooves formed on a face thereof, characterized in that a ratio W/S of a groove width W (mm) and a space width S (mm) between the grooves is from 0.5 to 2.0.

According to a second aspect of the invention according to the first aspect of the invention, the groove width W is from 0.5 to 1.6 mm.

According to a third aspect of the invention according to the first or the second aspect of the invention, a depth H of the groove is from 0.3 to 1.2 mm.

According to a fourth aspect of the invention according to any one of the first to third aspect of the invention, a cross-sectional shape of the groove is a rectangular shape or a U-shape.

According to a fifth aspect of the invention according to any one of the first to fourth aspect of the invention, the face is constituted of an insert member of a material different from that of a main body.

According to a sixth aspect of the invention according to the fifth aspect of the invention, the insert member is constituted of a laminate member formed by laminating plural materials.

According to a seventh aspect of the invention according to the sixth aspect of the invention, at least one layer of the laminate member is constituted of a metal, and at least another layer is constituted of a synthetic resin, a rubber or an elastomer.

As a result of investigations undertaken by the present inventors, it is found that the backspin could be reduced by decreasing a contact area between the face and the ball. Also a hit mark, left on the face of the putter after hitting the ball, investigated by applying a pressure-sensitive marking sheet on the face, is found as a mark having a diameter of 3 to 5 mm, indicating that the ball is deformed to a certain extent.

Therefore, the rolling amount of the ball is investigated by providing the putter head with grooves, similar to corrugations in an iron head, and by investigating an initial backspin amount of the ball. As a result, it is found that, in case of an iron head, the ball dip into the grooves to increase the backspin amount because the head speed is much faster than in the case of a putter, but, in case of a putter, the backspin amount decreases.

The present invention is made, based on such finding.

In the putter head of the present invention, as the putted bail has a low backspin amount as described above, the ball starts a forward spin in an earlier stage after leaving the face, and smoothly rolls on an aimed line. It is also possible to prevent a phenomenon, particularly when the grass leaves on the green are grown inversely, that the rolling distance does not stretch unexpectedly and remains excessively too short (leaving a long distance from the stopped ball to the hole). In the present invention, the feeling of hitting may be regulated by constituting the face with an insert member of a material different from that of the main body of the putter head.

DETAILED DESCRIPTION OF THE EMBODIMENTS

Now an exemplary embodiment of the present invention will be described with reference to the accompanying drawings.

Figure 1:
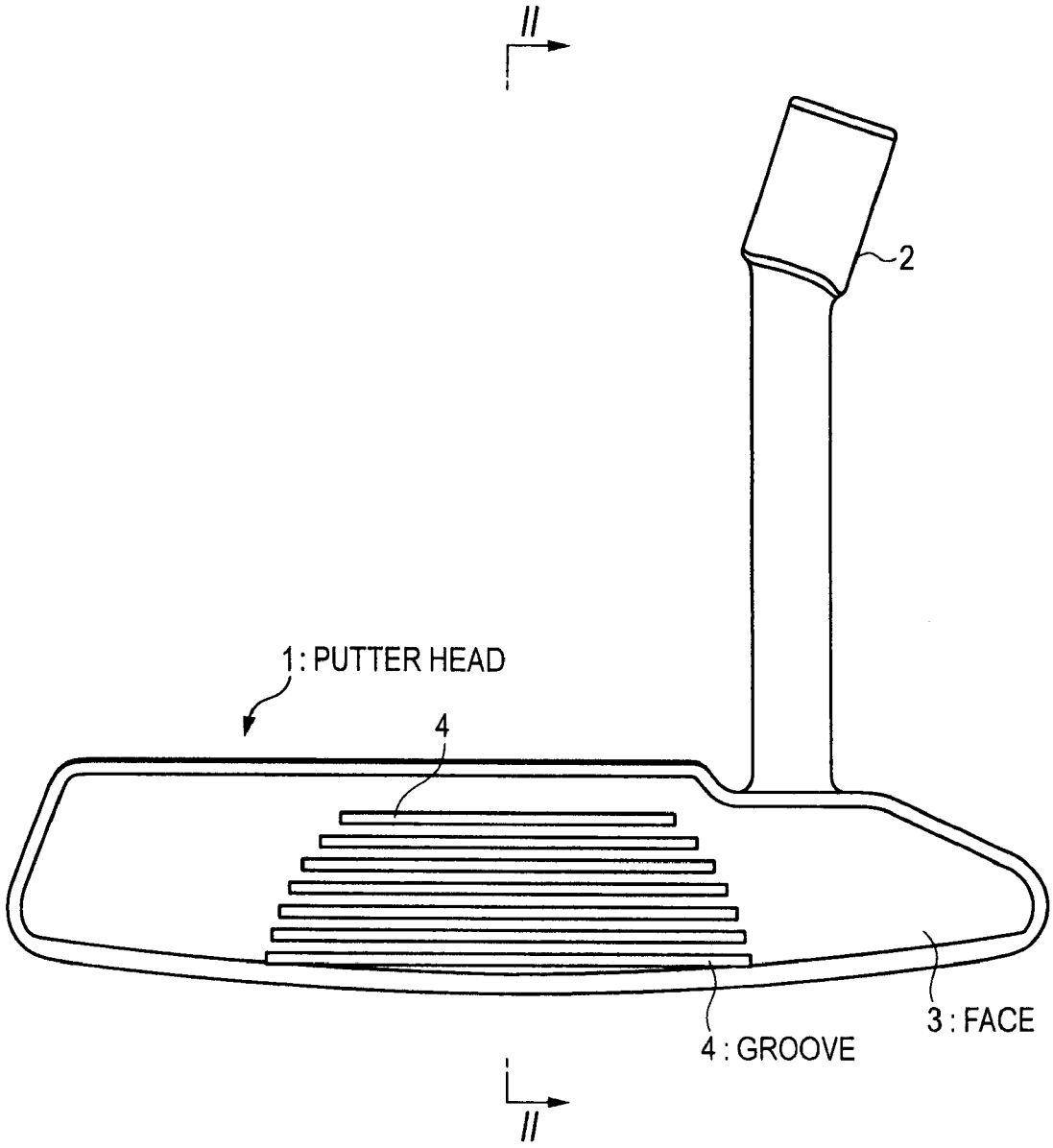
FIG. 1 is an elevation view of a putter head in an exemplary embodiment.
Figure 2:
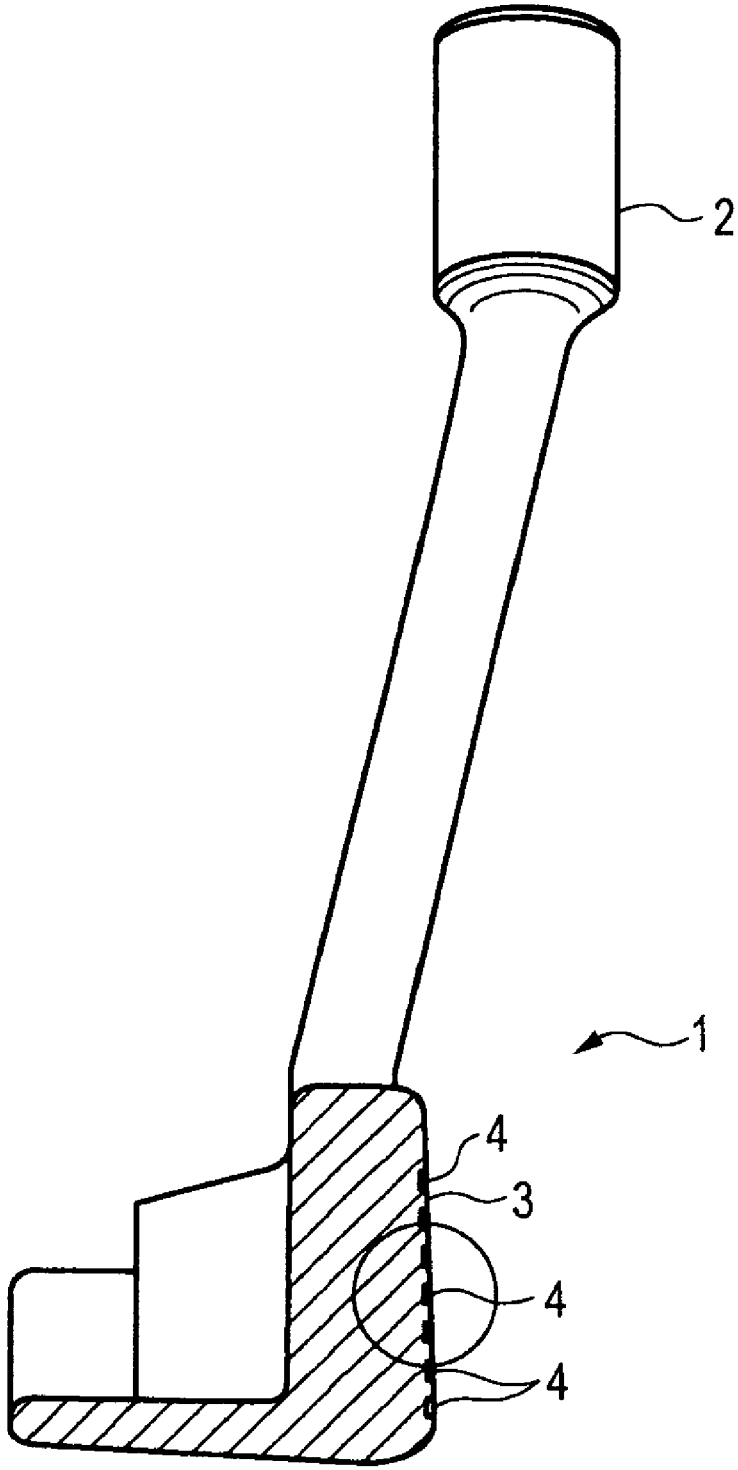
FIG. 2 is a cross-sectional view along a line II-II in FIG. 1.
Figure 3:
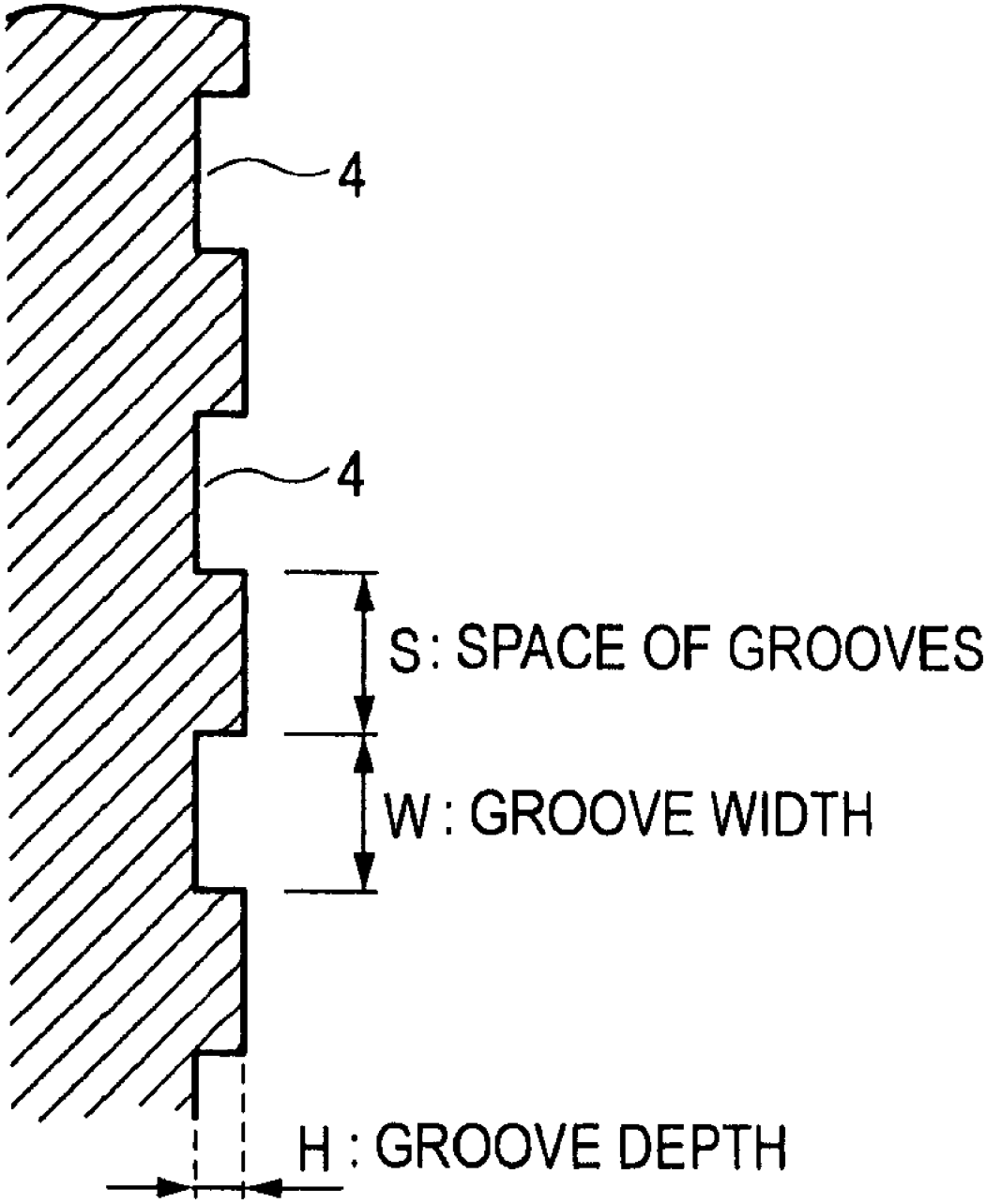
FIG. 3 is a partial magnified view of FIG. 2.

FIG. 1 is an elevation view of a putter head embodying the present invention, FIG. 2 is a cross-sectional view along a line II-II in FIG. 1, and FIG. 3 is a magnified view of a face portion in FIG. 2.

The putter head 1 is constructed as a putter, by inserting a shaft (not shown) into a hosel part 2 and fixing the shaft with an adhesive or the like.

On a face 3 of the putter head 1, plural grooves 4, extending along a toe-heel direction, are provided in parallel manner.

The grooves 4 extend horizontally in a soled state where a central portion, in the toe-heel direction, of a sole surface of the putter head 1 is contacted with a horizontal plane. A center of each groove 4 in the longitudinal direction thereof is positioned at about the center of the putter head in the toe-heel direction thereof.

The groove 4 preferably has a length of 5 mm or larger, particularly preferably 30 mm or larger. The groove 4 may be present over the entire length of the face 3 along the toe-heel direction thereof. A number of the grooves 4 is 3 or more, preferably about from 3 to 30.

A distance between a lower edge of a lowermost groove 4 and the sole surface of the putter head 1 is preferably 10 mm or less. In the case that the groove 4 is formed in an arc shape convex downwards, the lowermost groove 4 may be extended along the lower edge of face 3.

Now there will be explained a width of the groove 4, a space between the grooves, a depth and a cross-sectional shape of the groove.

In the present invention, a ratio W/S of a groove width W and a space width S between the grooves is from 0.2 to 2, preferably from 0.5 to 1.5 and particularly preferably from 0.6 to 1.3. A ratio W/S smaller than 0.5 is insufficient for the effect, while a ratio exceeding 2 may result in a fluctuation in the rolling distance of the ball, as the ball may contact or not contact a groove-tree portion only.

The groove width W is preferably from 0.5 to 1.6 mm, particularly from 0.5 to 1.25 mm and further preferably from 0.7 to 1.25 mm. The groove width is selected as 0.5 mm or larger as the formation of groove becomes difficult with a width less than 0.5 mm. Also the groove width is selected as 1.6 mm or less, since the hit mark of the ball has a diameter of about from 3 to 5 mm. A groove width exceeding 1.6 mm may result in a fluctuation in the rolling distance of the ball, by an edge of the groove.

The space S between the grooves is preferably about from 0.25 to 3.2 mm, particularly from 0.25 to 2.5 mm. The formation of groove becomes difficult with the space S between the grooves smaller than 0.25 mm.

The grooves 4 are provided for the purpose of decreasing the contact area between the face 3 and the ball. Therefore, a deeper groove 4 has no influence on the effect, but the depth is preferably 1.2 mm or less. Also the groove preferably has a depth of 0.03 mm or more, since the ball will be deformed by about 0.03 mm when the hit mark has a diameter of about 3 mm.

A cross-sectional shape of the groove may be any of a V-shaped groove, a U-shaped groove or a rectangle-shaped groove, but a U-shaped groove or a rectangle-shaped groove is preferable since the contact area of the face scarcely changes even when the ball is deformed. Also a corner where the face and the groove meet is preferably rounded in order to reduce the influence on the backspin.

In this exemplary embodiment, the grooves are formed in the lateral direction, but they also may be formed in the vertical direction. In such case, the groove width, the space between the grooves and W/S are same as explained above. Also in case of vertical grooves, the length thereof is preferably 5 mm or more.

A material for the putter head of the present invention may be selected arbitrarily, such as a metal, a synthetic resin, a rubber, ceramics or a fiber-reinforced resin. Also the face part alone may be formed by a material different from that constituting the main body part of the putter head.

The grooves 4 are linear in the aforementioned exemplary embodiment, but they may be formed in a curved form such as an arc shape. It is also possible to provide both lateral grooves and vertical grooves.

Figure 4:
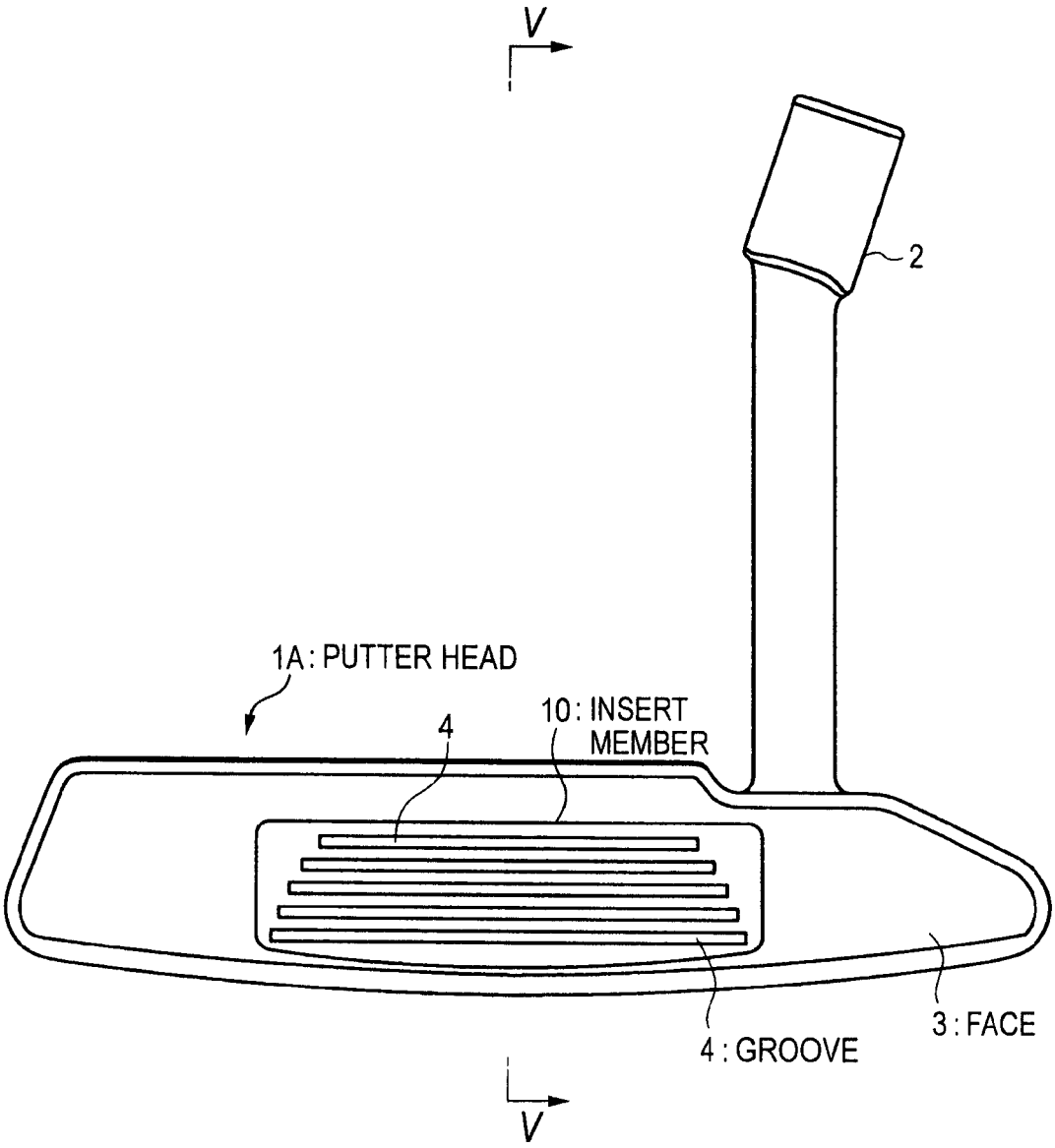
FIG. 4 is a elevation view of a putter head in another embodiment.
Figure 5:
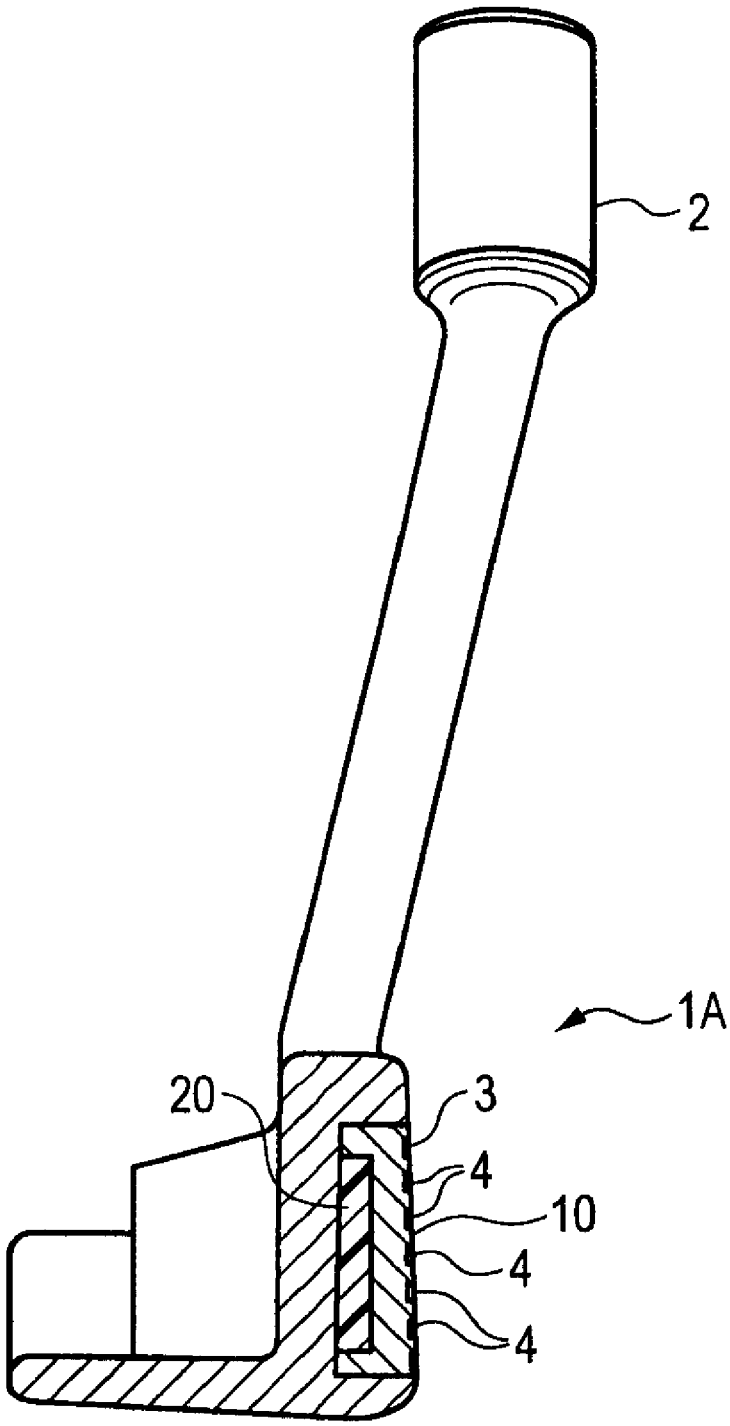
FIG. 5 is a cross-sectional view along a line V-V in FIG. 4.
Figure 6:
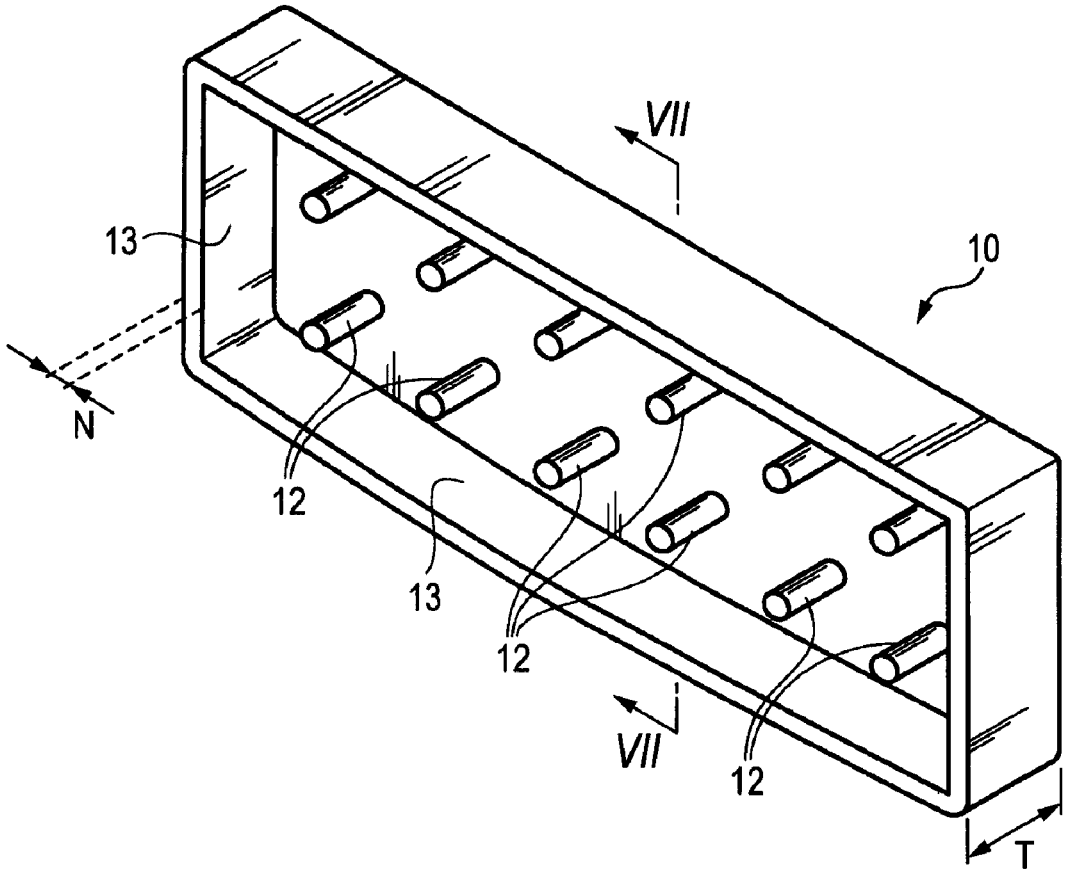
FIG. 6 is a perspective view of an insert member in FIG. 1.
Figure 7:
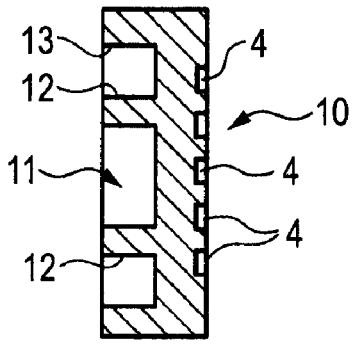
FIG. 7 is a cross-sectional view along a line VII-VII in FIG. 6.

Now an exemplary embodiment, in which the face is constituted of an insert member, will be described with reference to FIGS. 4 to 7. FIG. 4 is an elevation view of this putter head 1A; FIG. 5 is a cross-sectional view along a line V-V in FIG. 4; FIG. 6 is a perspective view of an insert member at a rear side thereof; and FIG. 7 is a cross-sectional view along a line VII-VI: in FIG. 6. The putter head 1A is same as the aforementioned putter head 1 except that insert members 10, 20 are provided, and like numbers indicate like portions.

A first insert member 10 has a substantially rectangular plate shape, of which a rear face is recessed as a concave 11, and the insert member 10 is provided with grooves 4 on a front face thereof.

On a rear surface of the insert member 10, corresponding to a bottom surface of the concave 11, plural (12 units in the present embodiment) protrusions 12 of a pillar-like shape, preferably a cylindrical shape, are provided. The protrusions 12 have such a height that free ends thereof are coplanar with a rear surface of a peripheral wall portion 13 of the concave 11.

The insert member 10 preferably has a total thickness of from 2 to 6 mm, a depth of the concave 11 or a height of the protrusions 12 of from 1 to 3 mm, a number of the protrusions 12 of from 10 to 30, a diameter of the protrusions 12 of from 1 to 3 mm, and a thickness n of the peripheral wall portion 13 of from about 1 to 3 mm. Also the insert member 10 preferably has a length in the toe-heel direction of about from 40 to 100 mm, and a height of about from 10 to 30 mm.

In the present embodiment, a second insert member 20 formed by a synthetic resin, a rubber or an elastomer is filled in the concave 11. The insert member 10, in which the second insert member 20 is filled in the concave 20, is fitted and adhered, by arm adhesive material, in a recessed portion of the main body of the head. The insert members may be made less easily detachable by forming the recessed portion wider in the interior and narrower at the entrance, in addition to or in place for the adhesive material. Also in case of adhering metals with each other or ceramic materials with each other, a fixing method such as caulking, welding or soldering may be adopted.

Such insert members 10, 20 provided on the face allow to regulate sensory elements of the putter head 1A, such as a feeling of hitting, a feeling of use and a touch.

The first insert member 10 is preferably formed by a metal such as titanium, a titanium alloy, stainless steel, soft iron, aluminum, an aluminum alloy or a precious metal, but may also be formed by a rubber or a synthetic resin, or also by ceramics or carbon.

The second insert member 20 is advantageously constituting of a synthetic resin such as polyurethane, nylon, polyester, or polycarbonate; a rubber such as silicone rubber, chloroprene rubber, nitrile rubber, natural rubber or styrene-butadiene rubber; or an elastomer such as a styrene type elastomer, an urethane type elastomer, an ethylene type elastomer, a polyester type elastomer, an olefin type elastomer or an amide type elastomer. Such synthetic resin preferably has a Shore-A hardness of about from 90 to 96, and such rubber or elastomer preferably has a Shore-A hardness of about from 20 to 30.

In the present invention, it is also possible to dispense with the second insert member 20 and to provide the first insert member 10 only.

In the following, Examples and Comparative Examples of the present invention will be described.

Examples 1 to 3 and Comparative Example 1

As the putter head, a Ping-type putter head having 1 loft angle of 4° (made of stainless steal SUD 304) is used for evaluation.

On the face, 6 grooves are formed as illustrated in a ball hitting portion (intermediate portion of the face in the toe-heel direction). The grooves are prepared as rectangle-sectioned grooves by machining. The length of the groove is made longest as 54 mm in the lowermost groove and shortest as 37 mm in the uppermost groove.

The grooves had a width of 0.75 mm and a depth of 0.4 mm.

A putter is prepared by mounting a steel shaft on the putter head.

Tests are conducted by a top-level amateur (advanced golfer). The tests are executed by a same swing, with a target distance of 2.5 meters. The spin amount of the ball is measured by imaging the ball, rolling on the green, with a high-speed camera. The ball flew for a certain distance immediately after being hit, then landed and rolled. Results of experiments are shown in Table 1, in which "rpm" indicates revolutions per minute.

TABLE 1

| No. | W (mm) | S (mm) | W/S (—) | initial backspin rpm | forward spin immediately after landing rpm | rolling distance m | Note |
|---|---|---|---|---|---|---|---|
| Comp. Ex. 1 | — | — | — | 28 | 276 | 2.51 | no groove |
| Example 1 | 0.75 | 1.5 | 0.5 | 24 | 319 | 2.59 | H = 0.4 mm |
| Example 2 | 0.75 | 0.75 | 1.0 | 16 | 340 | 2.70 | |
| Example 3 | 0.75 | 0.5 | 1.5 | 10 | 360 | 2.79 | |

As shown in Table 1, the putter head having grooves showed less initial backspin, more forward spin after landings and a better rolling, with an extended rolling distance.

Examples 4 and 5 and Comparative Example 2

Then the effect of groove width is evaluated by preparing putter heads with different groove widths, while maintaining W/S constant.

There are used a putter head having W=0.7 mm, S=0.63 mm, W/S=0.9 and H=0.4 mm (Example 4) and a putter head having W=1.25 mm, S=1.39 mm, W/S=0.9 and H=0.4 mm (Example 5).

Tests are conducted by a same swing with a target distance of 4.8 meters.

For the purpose of comparison, a putter head same as in Comparative Example 1 is tested under same conditions (Comparative Example 2). Results are shown in Table 2.

TABLE 2

| No. | W (mm) | S (mm) | W/S (—) | initial backspin rpm | forward spin immediately after landing rpm | rolling distance m | Note |
|---|---|---|---|---|---|---|---|
| Comp. Ex. 2 | — | — | — | 42 | 232 | 4.80 | no groove |
| Example 4 | 0.75 | 0.83 | 0.9 | 27 | 277 | 4.89 | H = 0.4 mm |
| Example 5 | 1.25 | 1.39 | 0.9 | 9 | 289 | 5.07 | |

As shown in Table 2, the putter heads of Examples 4 and 5 showed a reduced backspin and an extended rolling distance in comparison with that of Comparative Example 2.

Example 6

Samples of putter head 1A as illustrated in FIGS. 4 to 7 are prepared with the first insert members 10 and the second insert members 20, and used by golfers for testing, and the feeling of hitting is gathered. In the samples Nos. 1 and 2, the second insert member 20 is dispensed with and the first insert member 10 alone is used.

The dimensions of the first insert member 10 were as follows:

length in toe-heel direction: 60 mm height: 14 mm thickness T: 4 mm thickness N of peripheral wall: 1.5 mm depth of concave 11: 2 mm Combinations of the materials of the insert members are as follows. In the samples Nos. 3 to 8, the left side of a symbol "+" indicates the material of the first insert member, and the right side indicates the material of the second insert member:

No. 1 first insert member 10 of stainless steel only

No. 2: first insert member 10 of aluminum alloy only

No. 3: stainless steel+high hardness resin

No. 4; aluminum alloy+high hardness resin

No. 5: stainless steel+rubber

No. 6: aluminum alloy+rubber

No. 7: high hardness resin+rubber

No. 8: high hardness resin+high hardness resin

The stainless steel used is SUS304. The aluminum alloy used is 6061. The high hardness resin used is an urethane resin of a shore-A hardness of 95. The rubber used is nitrile rubber of a shore-A hardness of 25.

By arranging the evaluation results of softness of the feeling of hitting in an increasing order, the regulation in the feeling of hitting could be confirmed. Also the preference evaluated by 18 golfers is highest in No. 8, and then in a decreasing order of No. 5, No. 6, Nos. 1 and 2 (same preference), No. 3 and No. 7.

What is claimed is:

1. A golf club comprising:

a putter head having a face with a loft angle of 2 degrees to 5 degrees;

wherein substantially parallel plural grooves are formed on the face, and wherein a ratio W/S of a groove width W (mm) and a space width S (mm) between the grooves is from 0.5 to 2.0, wherein a depth H of the groove is from 0.03 to 1.2 mm.

2. The golf club according to claim 1, wherein the groove width W is from 0.5 to 1.6 mm.

3. The golf club according to claim 1, wherein a cross-sectional shape of the groove is a rectangular shape or a U-shape.

4. A golf club comprising:

a putter head having a face with a loft angle of 2 degrees to 5 degrees;

wherein substantially parallel plural grooves are formed on the face, and wherein a ratio W/S of a groove width W (mm) and a space width S (mm) between the grooves is from 0.5 to 2.0, wherein the face is constituted of an insert member of a material different from that of a main body.

5. The golf club according to claim 4, wherein the insert member is constituted of a laminate member formed by laminating plural materials.

6. The golf club according to claim 5, wherein:

at least one layer of the laminate member is constituted of a metal; and at least another layer is constituted of a synthetic resin, a rubber or an elastomer.

7. The golf club according to claim 4, wherein the insert member comprises a plurality of protrusions disposed on a rear surface of the insert member.

8. The golf club according to claim 7, wherein each of the plurality of protrusions have a height ranging from 1 to 3 mm.

9. The golf club according to claim 4, wherein the insert member comprises a cavity disposed on a rear face of the insert, wherein a second insert fills the cavity.

* * * * *